US005906876A

United States Patent [19]

Conway

[11] Patent Number: 5,906,876

[45] Date of Patent: May 25, 1999

[54] ABSORBENT FABRIC AND UNDERGARMENTS INCORPORATING THE FABRIC

[75] Inventor: David W. Conway, Loveland, Ohio

[73] Assignee: Intellitecs International, Inc., Mason, Ohio

[21] Appl. No.: 08/682,142

[22] Filed: Jul. 17, 1996

[51] Int. Cl.[6] ..... B32B 3/02

[52] U.S. Cl. ..... 428/89; 428/88; 428/95

[58] Field of Search ..... 428/88, 89, 95

[56] References Cited

U.S. PATENT DOCUMENTS

| | | | |
|---|---|---|---|
| Re. 30,972 | 6/1982 | Kyle et al. | 428/219 |
| 2,664,895 | 1/1954 | Shulman . | |
| 3,208,451 | 9/1965 | Porter et al. . | |
| 3,375,827 | 4/1968 | Bletzinger et al. . | |
| 3,481,337 | 12/1969 | Ruffo . | |
| 3,563,243 | 2/1971 | Lindquist | 128/287 |
| 3,666,608 | 5/1972 | Mattes | 428/88 |
| 3,720,212 | 3/1973 | Kaupin | 128/288 |
| 3,721,242 | 3/1973 | Krusko | 128/287 |
| 3,863,637 | 2/1975 | MacDonald et al. | 128/287 |
| 3,882,871 | 5/1975 | Taniguchi | 128/287 |
| 3,888,256 | 6/1975 | Studinger | 128/296 |
| 3,955,575 | 5/1976 | Okuda | 128/284 |
| 4,021,870 | 5/1977 | Walters | 5/334 R |
| 4,352,356 | 10/1982 | Tong | 128/288 |
| 4,527,403 | 7/1985 | Fullbright et al. | 66/177 |
| 4,576,848 | 3/1986 | Dillon et al. | 428/92 |
| 4,850,987 | 7/1989 | Gilomen | 604/385.1 |
| 4,981,480 | 1/1991 | Gaudet et al. | 604/386 |
| 5,065,600 | 11/1991 | Byles | 66/193 |
| 5,210,882 | 5/1993 | Moretz et al. | 2/404 |
| 5,217,782 | 6/1993 | Moretz et al. | 428/91 |
| 5,249,320 | 10/1993 | Moretz et al. | 5/484 |
| 5,261,901 | 11/1993 | Guay | 604/391 |
| 5,269,720 | 12/1993 | Moretz et al. | 450/37 |
| 5,290,269 | 3/1994 | Heiman | 604/378 |
| 5,291,617 | 3/1994 | Moretz et al. | 2/400 |
| 5,296,290 | 3/1994 | Brassington | 428/300 |
| 5,297,296 | 3/1994 | Moretz et al. | 2/237 |
| 5,306,536 | 4/1994 | Moretz et al. | 428/91 |
| 5,315,717 | 5/1994 | Moretz et al. | 2/400 |
| 5,392,467 | 2/1995 | Moretz et al. | 2/400 |
| 5,414,870 | 5/1995 | Moretz et al. | 2/400 |
| 5,435,014 | 7/1995 | Moretz et al. | 2/403 |
| 5,533,212 | 7/1996 | Moretz et al. | 2/409 |

FOREIGN PATENT DOCUMENTS 4997 4/1892 Switzerland .

OTHER PUBLICATIONS

English translation of Swiss patent document CH 4997 A, a document provided to the Examiner as item "AL" in the Supplemental Information Disclosure Statement filed on Dec. 12, 1997.

*Primary Examiner*—Terrel Morris
*Attorney, Agent, or Firm*—Wood, Herron & Evans, L.L.P.

[57] ABSTRACT

One embodiment of the fabric (10) of the present invention includes an upper portion (12), middle portion (20) and lower portion (14), with the upper portion (12) having raised surface construction hydrophobic first yarns (16), the lower portion having hydrophilic (18) second yarns and the middle portion (20) being a region in which ground yarns (22), hydrophobic first yarns (16) and hydrophilic second yarns (18) are integrated. The upper portion (12) further includes at least one channel (24), which is a region free of raised surface construction hydrophobic first yarns (16). The channel (24) facilitates transmission of fluid from the fabric upper portion (12) to the lower portion (14) by exposing a part of the lower portion hydrophilic second yarns (18) which extends into the middle portion (20) directly to fluid on the upper portion (12), thereby enabling the fluid to contact and be absorbed by a hydrophilic second yarn (18) without first having to wick along a raised surface construction hydrophobic first yarn (16). In a preferred embodiment, several adjacent channels (24) are aligned to form elongated channels (24) which intersect one another in a grid-like fashion. The fabric may be incorporated into undergarments, suitable examples of which include an infant T-shirt (52), a woman's panty (62) and a man's brief (70).

49 Claims, 3 Drawing Sheets

ABSORBENT FABRIC AND UNDERGARMENTS INCORPORATING THE FABRIC

BACKGROUND OF THE INVENTION

This invention relates to absorbent fabrics for managing bodily fluids and, more particularly, to absorbent fabrics which include hydrophobic yarns and which are reusable after washing. The invention also relates to washable and reusable undergarments which incorporate such absorbent fabrics.

The use of absorbent fabrics for managing bodily fluids is known. For example, several fabrics have been introduced which include multiple fabric layers, such as a body-facing hydrophobic layer or layers in combination with a garment-facing hydrophilic layer or layers, so as to wick moisture away from the body. These multiple layers are typically held together by stitching or adhesive. Unfortunately, the traditional multilayer fabrics tend to be quite thick, which makes them bulky and uncomfortable when incorporated into undergarments. Furthermore, this bulkiness makes such undergarments more noticeable underneath outer garments such as a dress or pair of pants.

More recently, absorbent fabrics have been introduced which incorporate the beneficial properties of hydrophobic and hydrophilic layers, without the thickness, bulk and discomfort of previous absorbent fabrics. These more recently developed fabrics are integrally knit fabrics having an uppermost top portion and a lower or bottom portion held together with an intermediate or middle portion. The top portion is a set of hydrophobic yarns having a raised surface construction, for example, loop pile, while the bottom portion includes a set of hydrophilic yarns, also usually having a raised surface construction. The middle portion includes one or more sets of ground yarns, which may be any yarns suitable for integrating the yarns of the top and bottom portions, as well as an inner portion of the hydrophobic and hydrophilic yarns themselves. One such fabric is shown in Heiman U.S. Pat. No. 5,290,269, and is available under the trademark COMPLY® from Standard Textile Co., Inc., located in Cincinnati, Ohio.

In addition to being relatively thin, such integrally knit fabrics also are able to absorb and retain significant amounts of fluid. When used to manage bodily fluids, the upper hydrophobic portion is placed against the body. Any fluids discharged by the wearer contact the raised hydrophobic yarns of the top portion, wick "down" the raised hydrophobic yarns toward the middle portion, where the fluid contacts and is absorbed by hydrophilic yarns in the middle portion, and pass into the bottom portion where the fluids are retained. Furthermore, due to the nature of the raised hydrophobic yarns and the generally close spacing of the yarns, fluid which has migrated into the bottom portion generally does not move back across the fabric to the upper surface of the top portion hydrophobic yarns, thereby providing a dry and comfortable feel to the wearer.

However, when such integrally knit fabrics receive a fluid discharge, droplets of fluid may remain on the body-facing surface of the top portion for a period of time before being wicked toward the hydrophilic yarns of the bottom portion, thereby extending the time it takes to move fluid away from the user's body, and making the wearer uncomfortable.

SUMMARY OF THE INVENTION

The present invention overcomes the above-mentioned drawback by providing a fabric in which sections of the upper portion of hydrophobic first yarns of raised surface construction are interrupted by a quick-absorbing channel or channels formed in the upper portion of the fabric. The channels define regions which are substantially free of raised surface construction hydrophobic first yarns, between selected groupings of such raised surface construction hydrophobic first yarns, and normally, these channels extend throughout the usable region of the fabric upper portion. With these channels, it is believed that fluid droplets located on the surface of the upper portion tend to move more quickly through the fabric and into the second yarns of the lower portion, in comparison with previous integrally knit fabrics. The second yarns may be either hydrophilic or hydrophobic. In addition, if these second yarns are hydrophobic, they may be advantageously selected or treated so as to be less hydrophobic (i.e., more hydrophilic) than the hydrophobic first yarns of the upper portion.

The channels may be formed so as to have any of a number of different shapes, patterns or designs. By way of example, each channel may appear as an isolated pocket. Alternatively, the channels may take the form of parallel lines or criss-crossing lines. In the latter, the crisscrossing lines may also define a grid of square or rectangular "clusters" of raised hydrophobic first yarns, separated from one another by the channels. Where the raised hydrophobic first yarns are formed as a loop pile, each channel has a width created by the absence of at least one pile loop, although a channel width created by the absence of at least two and as many as four pile loops is advantageous.

The significantly enhanced rate of fluid transmission caused by the channels is believed to exist for several reasons. For instance, because each channel is substantially free of raised surface construction hydrophobic first yarns, a part of the lower portion second yarns which extends into the middle portion is exposed directly to the upper portion, and to fluid located at the upper portion. When fluid initially impinges on the surface of the fabric upper portion, some of the fluid will drop into a channel, while other fluid droplets which initially contact hydrophobic first yarns having raised surface construction may roll across the surface into a channel. Once a fluid droplet enters a channel, it comes into immediate contact with the ground yarns and with a part of the lower portion second yarns which extend into the middle portion. That droplet then is quickly absorbed by, or wicked along, a lower portion second yarn, without first having had to wick downward along a hydrophobic first yarn or yarns having a raised surface construction.

The fabric of the present invention may also speed up transmission of fluid to the lower portion by more quickly wetting the raised hydrophobic first yarns at their bases located in the middle portion, that is, the portion of the raised hydrophobic first yarns which meets the second yarns of the bottom portion. This wetting is believed to occur because, as fluid droplets enter into the channels of the upper portion, fluid from these droplets moves not only downward into the lower portion, but also laterally across the plane of the fabric middle portion, thereby wetting the bases of many of the raised hydrophobic first yarns. This wetting enhances the wickability of these raised hydrophobic first yarns, and increases the rate at which fluid is transported "down" the length of these yarns and into the lower portion. The lower portion may advantageously include second yarns directly opposite the channels.

In accordance with a further feature of the invention, the fabric is incorporated into an undergarment. Such an undergarment typically includes a body portion having a crotch area, with the integrally knit fabric of the present invention formed as a crotch panel and covering at least a portion of the crotch area. The channel-containing outer surface is positioned to face the wearer to thereby dramatically increase the absorbent capacity of the undergarment. If desired, a liquid barrier material also may be placed between the absorbent fabric and the undergarment itself, so as to prevent fluid from passing through the absorbent panel onto the undergarment. Examples of such undergarments include an infant T-shirt, a woman's panty and a man's brief.

By virtue of the foregoing, there is thus provided an absorbent fabric with a significantly enhanced rate of fluid transmission. In addition, this fabric is suitable for use with many different styles of undergarments, and because of its enhanced ability to move fluid away from the user, the fabric is able to enhance user comfort and confidence. These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with the general description of the invention given above and the detailed description given below, serve to explain the principles of the invention.

DETAILED DESCRIPTION OF THE INVENTION

Figure 1:
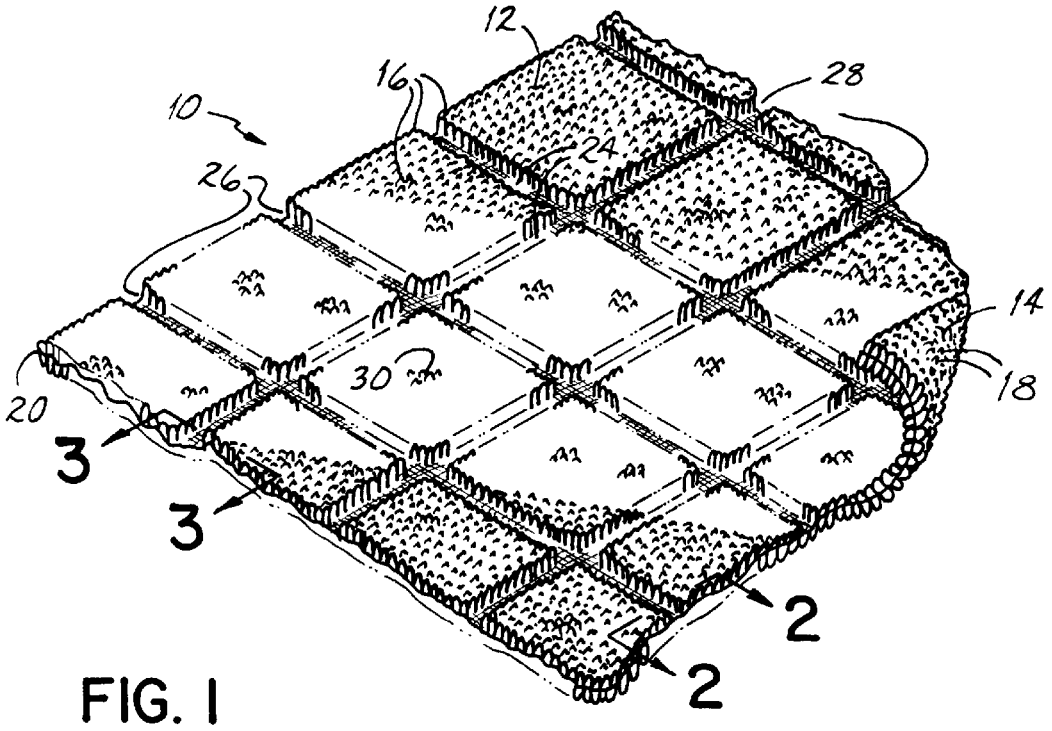
FIG. 1 is a schematic perspective view of an embodiment of the fabric of the present invention.
Figure 2:
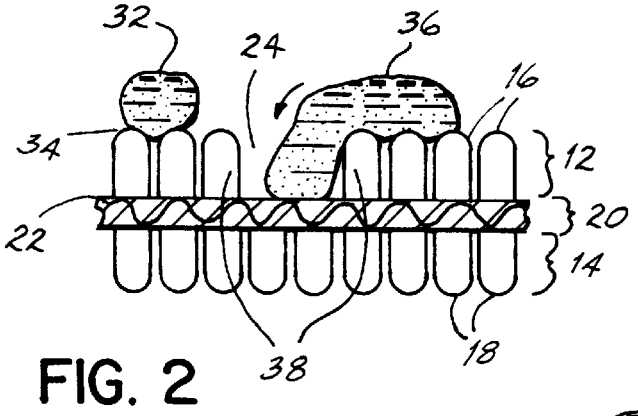
FIG. 2 is a schematic cross-sectional view of a portion of the fabric of FIG. 1 taken along line 2—2.
Figure 3:
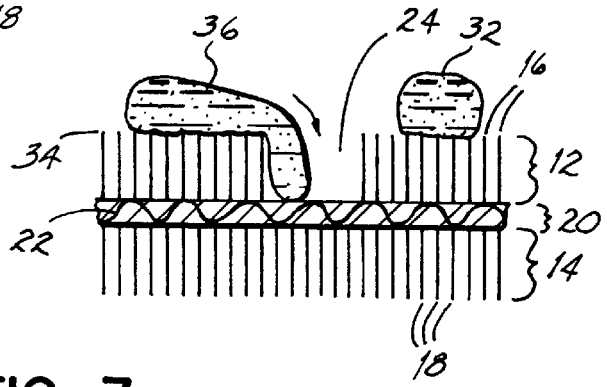
FIG. 3 is a schematic cross-sectional view of a portion of the fabric of FIG. 1 taken along line 3—3.

With reference to FIGS. 1–3, an embodiment of the fabric 10 according to the principles of the invention is shown having an upper portion 12 and a lower portion 14. The upper portion 12 includes a plurality of hydrophobic first yarns 16 (such as polyester or polypropylene yarns of 168 denier) formed in a loop pile construction, and the lower portion 14 includes a plurality of second yarns 18 which also are formed in a loop pile construction. Second yarns 18 may be hydrophilic (such as cotton yarns of 18 singles). Additionally, the fabric 10 has a middle portion 20 which includes a set of ground yarns 22 (such as 50/50 polyester/cotton blended yarn) and parts of the hydrophobic and hydrophilic yarns 16, 18, the ground yarns 22 serving to integrate the hydrophobic and hydrophilic yarns 16, 18 of the upper and lower portions 12, 14 into a single layer fabric. This general construction is described in Heiman U.S. Pat. No. 5,290,269 and Byles U.S. Pat. No. 5,065,600, the disclosures of both of which are incorporated herein in their entirety by reference.

In accordance with the principles of the present invention, a plurality of elongated channels 24 are formed in the upper portion 12. These channels 24 are formed by not knitting selected hydrophobic first yarns 16 in the loop pile construction in the region of the channels 24. In the embodiment of fabric 10 shown in FIGS. 1–3, the channels 24 define a plurality of first and second channel rows 26, 28, respectively, which intersect one another, such as at right angles, to form a grid-like pattern. As best shown in FIGS. 2 and 3, the elongated channels 24 are regions of the upper portion 12 in which the knitting operation is suspended so as to create regions which are substantially free of loop pile. Each of these channel regions is located between a selected grouping of clusters 30 of loop pile yarns. The channels 24 may be formed by the absence of at least one pile loop, although it is advantageous to have the channels formed by the absence during knitting of at least two such pile loops, as shown in the embodiment of FIGS. 1–3. Although any number of pile loops may be absent, it is advantageous to limit the number to not more than four. Typically, channels formed by the absence of one pile loop have a width of about 1 millimeter, while those formed by the absence of two pile loops have a width of about 2 millimeters. If four pile loops are omitted, such a channel 24 generally has a width of about 4 millimeters, although these widths may vary depending upon the knitting or weaving system employed to make the fabric 10.

With particular reference to FIGS. 2 and 3, channels 24 of the fabric upper portion 12 are particularly beneficial in accelerating the movement of fluid from the fabric upper portion 12 to the hydrophilic second yarns 18 of the lower portion 14. When the fabric 10 receives a fluid discharge 32, such as a urinary discharge, menstrual discharge or the like, the fluid typically rests adjacent the upper surface 34 of the upper portion hydrophobic yarns 16 for a brief period of time before it is wicked along the length of the loop pile hydrophobic yarns 16 and down into the lower portion hydrophilic yarns 18. The reason for this initial period of time during which the fluid remains on the surface 34 of the fabric 10 may be due to the fluid droplets from the discharge having a significant surface tension owing to the strong intramolecular forces within the droplets. And, because the raised surface construction of the fabric upper portion 12 places the hydrophobic yarns 16 so close together, the fluid droplets generally are much larger than the narrow spaces between adjacent pile loops. Therefore, the fluid droplets must wait on the surface 34 until they are wicked downward along the length of the pile loops and into the hydrophilic yarns 18 of the lower portion 14. However, with the presence of the channels 24, many of the fluid droplets located on the surface 34 of the upper portion 12 have much more immediate access to the hydrophilic yarns 18 of the fabric lower portion 14, thereby greatly facilitating the rate with which fluid moves from the fabric upper portion 12 into the lower portion 14. Fluid droplets 36 may enter the channel 24 either by directly contacting the channel 24 initially upon discharge, or by moving generally laterally across the surface 34 of the upper portion 12 (or perhaps with some wicking action of loops 38 adjacent channel 24) and into the channel 24. Once a droplet enters the channel 24, it comes in contact with the middle portion 20 of the fabric 10, where a part of the hydrophilic yarns 18 of the lower portion 14 are exposed to the upper portion 12 of the fabric 10. At this point, the droplet is readily absorbed into the hydrophilic yarns 18 of the middle portion 20 and is wicked into the lower portion 14. As shown in FIGS. 2–3, the lower portion 14 advantageously includes yarns 18 directly opposite the channels 24. However, this is not required. For example, the lower portion 14 may include a channel or channels (not shown) which also are created by the absence of selected yarns. In this case, water droplets would be able to wick into the other yarns of the lower portion.

As shown in FIGS. 1–3, the elongated channels 24 have a width which corresponds to approximately two pile loops. However, a channel having a width of even a single pile loop is beneficial in facilitating movement of fluid from the surface of the upper portion down into the lower portion. If desired, the channels may have a width greater than two loop piles, although the width advantageously would correspond to not more than three or four loop piles. Because of the raised surface construction of the hydrophobic yarns 16 of the upper portion 12, the surface 34 of the upper portion 12 provides a generally dry feel to the user of the fabric 10 after a discharge, even at or near the channels 24.

Figure 4:
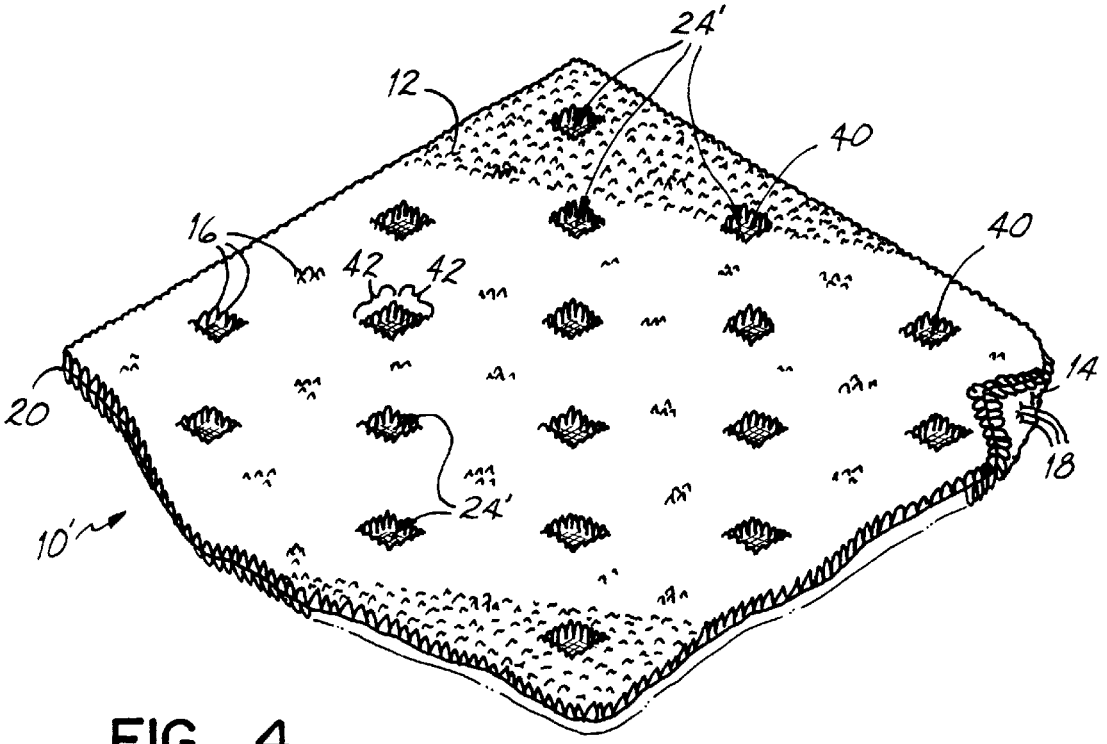
FIG. 4 is a schematic perspective view of another embodiment of the fabric according to the principles of the invention.
Figure 5:
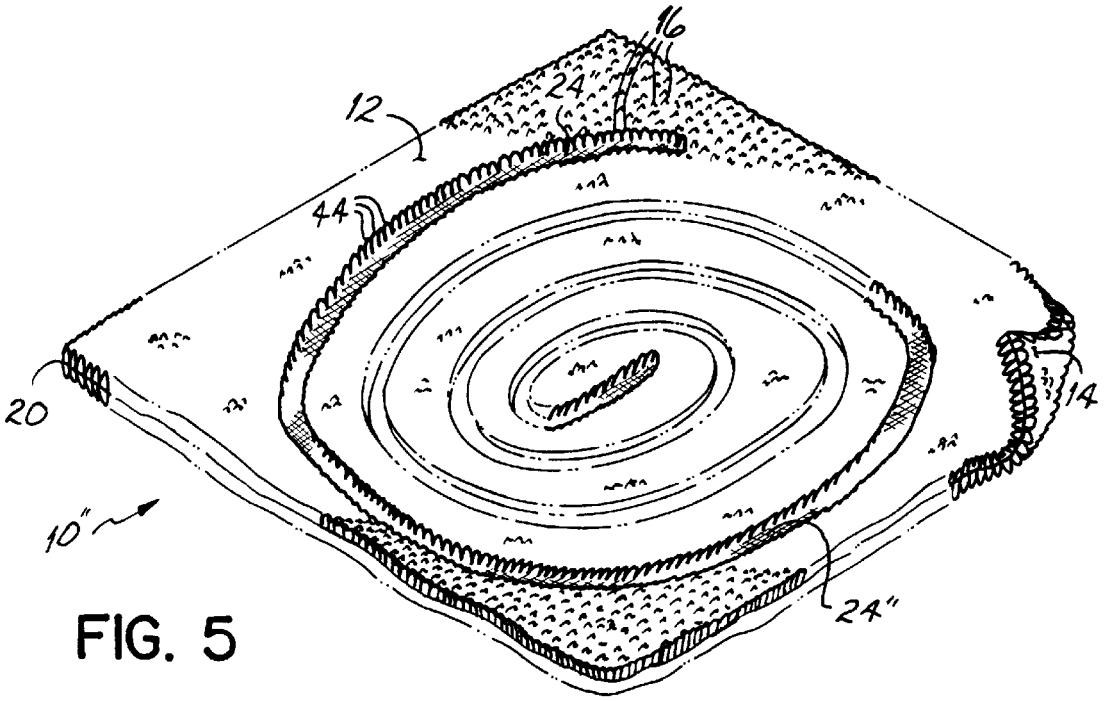
FIG. 5 is a schematic perspective view of yet another embodiment of the fabric according to the invention.

Although the fabric of the present invention has been described above with respect to one particular embodiment, the fabric may have many different forms. For example, with reference to FIG. 4, another embodiment of the fabric 10' is shown, having the same upper and lower portions 12, 14 and middle portion 20, but where there are several discrete channels 24'. The channels 24' are distributed as individual pockets 40 across the upper portion 12 of the fabric 10'. Each pocket 40 is a region of the upper portion 12 which is free of a hydrophobic yarn or yarns having a raised surface construction 16 and is surrounded on all sides by a selected grouping 42 of the hydrophobic yarns. With reference to FIG. 5, yet another embodiment of the fabric 10" is shown, which is similar to fabrics 10 and 10' but with essentially one channel 24" having a generally serpentine configuration which wraps about itself through the extent of the fabric. The channel 24" is thus bounded laterally by a selected grouping 44 of hydrophobic yarns along its length. Regardless of the particular embodiment, however, the channel or channels normally will extend throughout the usable region of the fabric upper portion.

In any of the embodiments shown and described, the fabric may be subjected to laundering to cleanse the bodily discharge therefrom and allow reuse of the fabric. Typically, home laundering is possible where the hydrophobic first yarns are polypropylene although polyester may be necessary where institutional laundering is employed. Further, it may be advisable to avoid use of fabric softener.

Although several of the embodiments discussed above show the hydrophobic first yarns of the upper portion in a loop pile configuration, it is to be understood that the hydrophobic first yarns may be formed or processed so as to have any raised surface construction. As used herein, the term "raised surface construction" refers to any construction or yarn processing which enables the hydrophobic first yarns of the upper portion to substantially cover the second yarns of the lower portion, whereby fluid on the upper surface of the hydrophobic first yarns, in order to pass into the lower portion, must either: (1) wick along the hydrophobic yarns to ward the lower portion second yarns, or (2) move into one of the channels of the fabric upper portion whereby the fluid is able to come into immediate contact with the part of the second yarns of the lower portion which is located in the middle portion.

Pile construction and napped construction are two examples of the numerous forms of raised surface construction. As known in the art, pile construction may include, for example, a fabric effect formed by introducing tufts, loops or other erect yarns on the fabric surface. Some types include warp, filling and knotted pile, or loops produced by weaving a set or sets of yarns over wires that are then drawn out of the fabric. Furthermore, if desired, pile loops may be cut so as to form cut pile. Napped construction refers to any construction in which yarns have been subjected to a process which raises surface fibers, such as brushing, sanding or napping, for example. One particular form of napping involves passing surface fibers of a fabric over revolving cylinders covered with metal points or teased burrs.

Although the particular embodiments discussed above in connection with FIGS. 1–5 include lower portion second yarns which may be hydrophilic, the invention is not so limited. Alternatively, these second yarns may be hydrophobic, like yarns 16. In addition, where yarns 18 are hydrophobic, they may be selected or treated so as to be less hydrophobic than the hydrophobic first yarns 16 of the upper portion. Examples of first yarn/second yarn pairings in which the second yarn is less hydrophobic include polyester/rayon, polyester/acetate and polyester/acrylic. As used herein, the term "less hydrophobic" refers to a material which experiences a greater moisture pick-up under a standard atmosphere for testing, as those terms are defined in ASTM D 4920-89. For the benefit of the reader, ASTM D 4920-89 defines "moisture pick-up" as the mass of absorbed and adsorbed water that is held by a material, compared to the mass of the dried material. This same ASTM Designation defines "a standard atmosphere for testing" as an atmosphere in which the conditions for relative humidity and temperature are specified and controlled.

Figure 6:
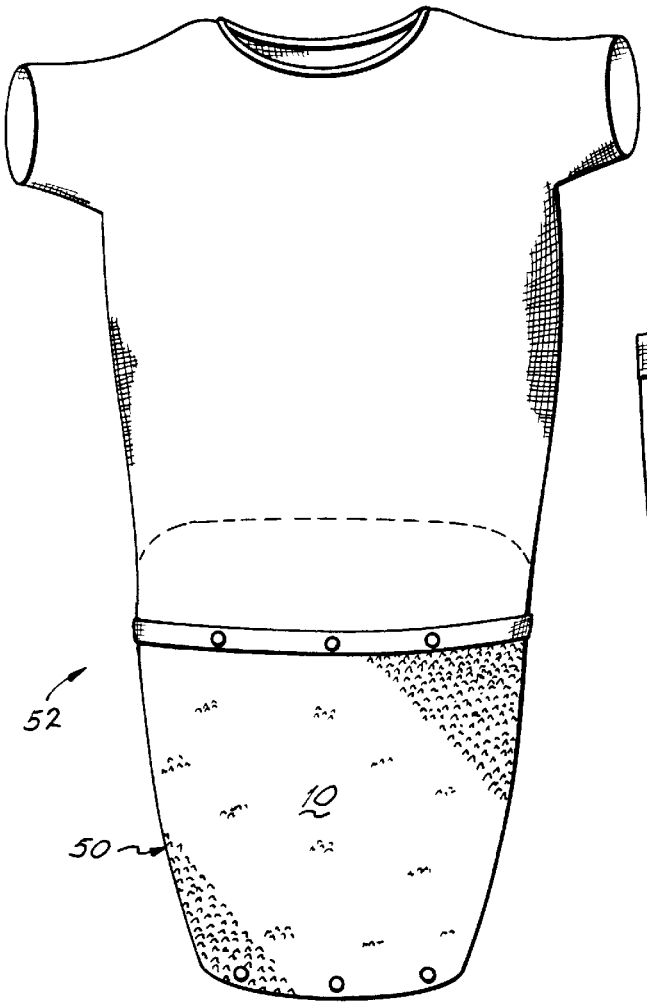
FIG. 6 is a front view of an infant T-shirt having an unfastened crotch panel incorporating the features of the present invention.

Fabric made according to the principles of the present invention may be used in a number of different product s. For example, fabric 10 as shown in FIG. 1 may be incorporated into the crotch panel 50 of an infant T-shirt 52 as shown in FIG. 6. Such infant T-shirts are described in detail in U.S. Pat. No. 5,819,317, issued Oct. 13, 1998 and entitled "INFANT T-SHIRT" the entire disclosure of which is incorporated herein by reference, and so will not be repeated herein. Suffice it to say that, if desired, the fabric 10 of the present invention may be substituted for the absorbent layer 50 located in the crotch panel 14 of the infant T-shirt 10 shown in that application.

Figure 8:
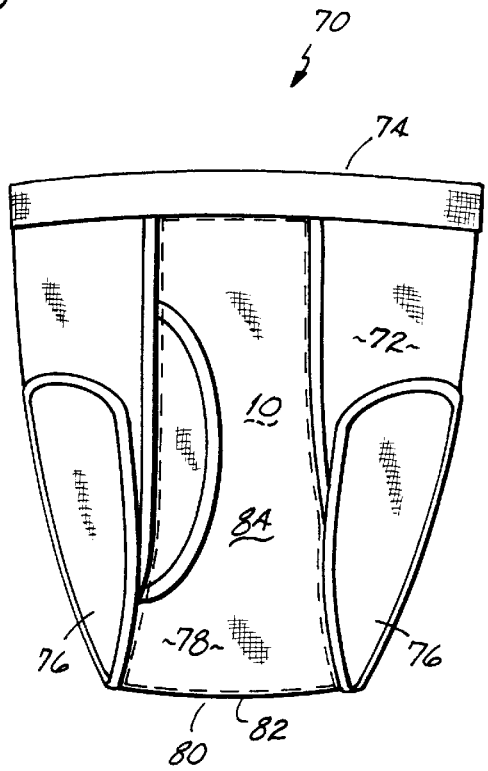
FIG. 8 is a front view of a man's brief having a crotch area which incorporates a crotch panel made according to the principles of the invention.
Figure 7:
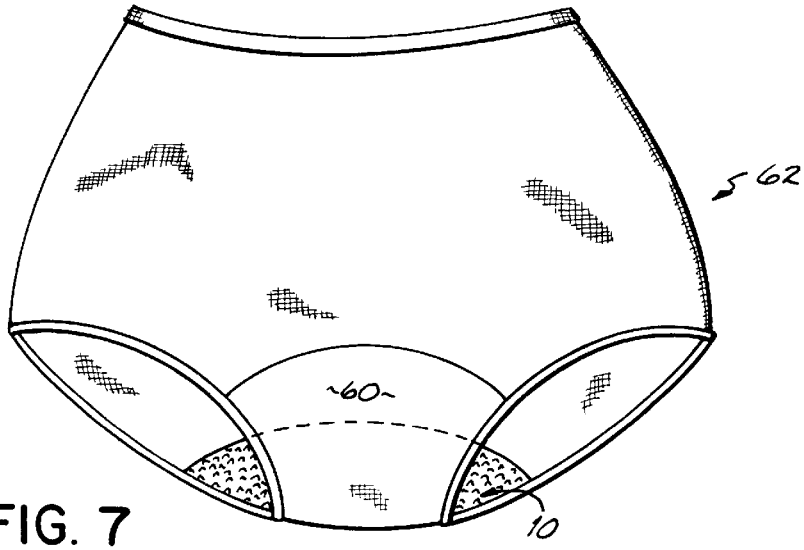
FIG. 7 is a front view of a woman's panty having a crotch panel in accordance with the principles of the present invention.

Similarly, a fabric according to the principles of the present invention may be applied to women's panties and men's underwear, as shown in FIGS. 7 and 8, respectively. With reference to FIG. 7, fabric 10 may be incorporated into the crotch area 60 of a woman's panty 62, such as the type of panty described in detail in U.S. Pat. No. 5,778,457, issued Jul. 14, 1998 and entitled "HYGIENIC PANTY AND QUICK-ATTACH PAD", the entire disclosure of which is incorporated herein by reference, and so will not be repeated herein. Suffice it to say that, if desired, the fabric 10 may be used in place of the absorbent layer 38 of the crotch panel 12 of the woman's panty 10 shown in that application. Preferably, the raised surface content of the present fabric should continue to have loop pile, so as to provide the added benefit of utility with a quick attach pad as described in that application.

With reference to FIG. 8, the particular embodiment shown is a man's brief 70 including a body portion 72, an upper waist opening 74, a pair of lower leg openings 76 and a crotch area 78 disposed between the leg openings 76. The undergarment further includes a midline 80 at the very base 82 of the undergarment, which extends from one lower leg opening 76 to the other. An absorbent crotch panel 84 extends upward from this midline 80, through the portion of the crotch area 78 in the front of the undergarment to the upper waist opening 74. This crotch panel 84 may include, for example, the fabric 10 of the present invention, and preferably further includes a liquid-proof barrier layer between the absorbent fabric and the outermost fabric layer of the undergarment itself (as described in connection with the infant T-shirt and women's panty in their respective patent applications), thereby preventing fluid from passing through the undergarment and onto an outer piece of clothing.

While the present invention has been illustrated by description of embodiments, and while the illustrative embodiments have been described in considerable detail, it is not the intention of the inventor to restrict or in any way limit the scope of the appended claims to such detail. Additional advantages and modifications will readily appear to those skilled in the art. For example, the channelled fabric of the present invention may be used to form, or be included as part of, diapers, incontinent pads or boxer shorts, or other garments requiring movement of fluids away from the body and into an absorbent layer spaced away from the body. In addition, although the fabric embodiments discussed above have included a set of ground yarns, to form an integral fabric, the upper and lower portions need not be integrally woven together. For example, the upper portion may be placed in fluid communication with the lower portion by peripherally stitching or quilting the two portions together. Further, the fabric may have an intervening layer or layers which lie between the upper and lower portions. These intervening layers may be either hydrophobic or hydrophilic. The invention in its broader aspects is therefore not limited to the specific details, representative apparatus and methods, and illustrative examples shown and described. Accordingly, departures may be made from such details without departing from the spirit or scope of the inventor's general inventive concept.

Having described the invention, what is claimed is:

1. A fabric, comprising:

an upper portion having a plurality of hydrophobic first yarns of raised surface construction and a lower portion having a plurality of second yarns, the hydrophobic first yarns being in fluid communication with the second yarns whereby fluid may be wicked from the upper portion to the lower portion, the upper portion further including at least one channel, the channel being a region free of one or more of the hydrophobic first yarns located between a selected grouping of the hydrophobic first yarns of raised surface construction, whereby to facilitate removal of fluid from the upper portion of the fabric.

2. The fabric of claim 1 wherein the second yarns are hydrophilic.

3. The fabric of claim 1 wherein the second yarns are hydrophobic.

4. The fabric of claim 3 wherein the second yarns are less hydrophobic than the hydrophobic first yarns.

5. The fabric of claim 1 wherein the fabric includes a plurality of channels.

6. The fabric of claim 5 wherein the channels are arranged in parallel rows.

7. The fabric of claim 6 wherein the rows are spaced about one inch apart from one another.

8. The fabric of claim 5 wherein the channels are arranged in a criss-crossing pattern of rows.

9. The fabric of claim 8 wherein the criss-crossing rows are substantially perpendicular to one another.

10. The fabric of claim 5 wherein the channels define a plurality of discrete pockets.

11. The fabric of claim 1 wherein the channel has an elongated, serpentine shape.

12. The fabric of claim 1 wherein the raised surface construction is selected from the group consisting of a pile construction, a napped construction and combinations thereof.

13. The fabric of claim 1 wherein the raised surface construction includes a loop pile construction, the channel having a width created by the absence of at least 2 pile loops.

14. The fabric of claim 13 wherein the channel has a width created by the absence of not more than 4 pile loops.

15. The fabric of claim 1 wherein the hydrophobic first yarns include polypropylene.

16. The fabric of claim 1 wherein the fabric includes at least one set of ground yarns for integrating the hydrophobic first yarns and the second yarns.

17. An undergarment, comprising:

a body portion having a crotch area, the body portion having a crotch panel associated with at least a portion of the crotch area, the crotch panel including an absorbent fabric comprising:

an upper portion having a plurality of hydrophobic first yarns of raised surface construction and a lower portion having a plurality of second yarns, the hydrophobic first yarns being in fluid communication with the second yarns whereby fluid may be wicked from the upper portion to the lower portion, the upper portion further including at least one channel, the channel being a region free of one or more of the hydrophobic first yarns located between a selected grouping of the hydrophobic first yarns of raised surface construction, whereby to facilitate removal of fluid from the upper portion of the fabric.

18. The undergarment of claim 17 wherein the second yarns are hydrophilic.

19. The undergarment of claim 17 wherein the second yarns are hydrophobic.

20. The undergarment of claim 19 wherein the second yarns are less hydrophobic than the hydrophobic first yarns.

21. The undergarment of claim 17 wherein the absorbent fabric includes a plurality of channels.

22. The undergarment of claim 21 wherein the channels are arranged in parallel rows.

23. The undergarment of claim 21 wherein the channels are arranged in a criss-crossing pattern of rows.

24. The undergarment of claim 23 wherein the criss-crossing rows are substantially perpendicular to one another.

25. The undergarment of claim 21 wherein the channels define a plurality of discrete pockets.

26. The undergarment of claim 17 wherein the channel has an elongated, serpentine shape.

27. The undergarment of claim 17 wherein the raised surface construction is selected from the group consisting of a pile construction, a napped construction and combinations thereof.

28. The undergarment of claim 17 wherein the raised surface construction includes a loop pile construction.

29. The undergarment of claim 28 wherein the channel has a width created by the absence of at least 2 pile loops.

30. The undergarment of claim 28 wherein the channel has a width created by the absence of not more than 4 pile loops.

31. The undergarment of claim 17 wherein the hydrophobic first yarns include polypropylene.

32. The undergarment of claim 17 wherein the undergarment is an infant t-shirt.

33. The undergarment of claim 17 wherein the undergarment is a woman's panty.

34. The undergarment of claim 17 wherein the undergarment is a man's brief.

35. A wearable garment having a portion adapted to face a wearer, and an absorbent fabric held against said wearer-facing portion, the absorbent fabric comprising:

an upper portion facing away from the garment and having a plurality of hydrophobic first yarns of raised surface construction, and a lower portion facing toward the garment and having a plurality of second yarns, the hydrophobic first yarns being in fluid communication with the second yarns whereby fluid may be wicked from the upper portion to the lower portion, the upper portion further including at least one channel, the channel being a region free of one or more of the hydrophobic first yarns located between a selected grouping of the hydrophobic first yarns of raised surface construction, whereby to facilitate removal of fluid from the upper portion of the fabric.

36. The wearable garment of claim 35 wherein the second yarns are hydrophilic.

37. The wearable garment of claim 35 wherein the second yarns are hydrophobic.

38. The wearable garment of claim 37 wherein the second yarns are less hydrophobic than the hydrophobic first yarns.

39. A woven or knitted fabric, comprising:

an upper portion having a plurality of clusters of raised surface construction hydrophobic first yarns and a lower portion having second yarns, the lower portion being in fluid communication with the upper-portion to enable fluid to wick from the upper portion to the lower portion, adjacent clusters of raised surface construction hydrophobic first yarns being spaced apart so as to form at least one channel, the channel being a region free of one or more of the hydrophobic first yarns, whereby to facilitate removal of fluid from the upper portion of the fabric.

40. The fabric of claim 39 wherein the second yarns are hydrophilic.

41. The fabric of claim 39 wherein the second yarns are hydrophobic.

42. The fabric of claim 41 wherein the second yarns are less hydrophobic than the hydrophobic first yarns.

43. The fabric of claim 39 wherein multiple sets of adjacent clusters are spaced apart to define a plurality of said channels.

44. The fabric of claim 43 wherein multiple sets of adjacent clusters are spaced apart to define parallel rows of channels.

45. The fabric of claim 43 wherein multiple sets of adjacent clusters are spaced apart to define criss-crossing rows of channels.

46. The fabric of claim 43 wherein multiple sets of adjacent clusters cooperate to define discrete pockets of channels.

47. The fabric of claim 39 wherein the adjacent clusters cooperate to define an elongated, serpentine shape to the channel.

48. The fabric of claim 39 wherein the hydrophobic first yarns include polypropylene.

49. The fabric of claim 39 wherein the fabric includes at least one set of ground yarns for integrating the hydrophobic first yarns and the second yarns.

* * * * *